US006859198B2

(12) United States Patent
Onodera et al.

(10) Patent No.: US 6,859,198 B2
(45) **Date of Patent: *Feb. 22, 2005**

(54) FORCE FEEDBACK FUNCTIONING MANUAL INPUT DEVICE AND ONBOARD INSTRUMENT CONTROL SYSTEM HAVING IT

(75) Inventors: Mikio Onodera, Miyagi-ken (JP); Hidetaka Numata, Miyagi-ken (JP); Kenichi Seino, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 221 days.

This patent is subject to a terminal disclaimer.

(21) Appl. No.: 10/027,451

(22) Filed: Dec. 20, 2001

(65) Prior Publication Data

US 2002/0080115 A1 Jun. 27, 2002

(30) Foreign Application Priority Data

Dec. 22, 2000 (JP) ..... 2000-391239
Dec. 22, 2000 (JP) ..... 2000-391244

(51) Int. Cl.[7] ..... G09G 5/00; G09G 5/08

(52) U.S. Cl. ..... 345/161; 345/156; 345/157; 463/38; D14/412

(58) Field of Search ..... 345/156, 157, 345/161, 184, 701; 463/38; 701/1, 36; 700/83; 307/10.1; 341/20; D14/412

(56) References Cited

U.S. PATENT DOCUMENTS 5,589,828 A * 12/1996 Armstrong ..... 341/20
5,831,596 A * 11/1998 Marshall et al.
6,030,291 A * 2/2000 Maki et al. ..... 463/38
6,057,828 A 5/2000 Rosenberg et al.
6,154,201 A * 11/2000 Levin et al. ..... 345/184
6,195,592 B1 * 2/2001 Schuler et al. ..... 700/83
D438,847 S * 3/2001 Hasegawa ..... D14/412
6,348,911 B1 * 2/2002 Rosenberg et al. ..... 345/161
6,448,670 B1 * 9/2002 Onodera et al. ..... 307/10.1
6,486,872 B2 * 11/2002 Rosenberg et al. ..... 345/161
6,593,667 B1 * 7/2003 Onodera et al. ..... 307/10.1
6,636,197 B1 * 10/2003 Goldenberg et al. ..... 345/161
2001/0052893 A1 * 12/2001 Jolly et al.
2002/0054060 A1 * 5/2002 Schena ..... 345/701
2002/0080116 A1 * 6/2002 Onodera et al. ..... 345/161
2002/0097223 A1 * 7/2002 Rosenberg
2002/0133276 A1 * 9/2002 Onodera ..... 701/36
2002/0196233 A1 * 12/2002 Kataoka et al. ..... 345/161

FOREIGN PATENT DOCUMENTS

DE 197 12 048 A1 9/1998
DE 197 52 056 A1 5/1999
WO WO 98/43261 10/1998

* cited by examiner

*Primary Examiner*—Bipin Shalwala
*Assistant Examiner*—David L. Lewis
(74) *Attorney, Agent, or Firm*—Brinks Hofer Gilson & Lione

(57) ABSTRACT

A manual in put device is provided with a spherical bearing, a joystick type knob held swingably on the spherical bearing, a rotary knob disposed coaxially with the joystick type knob, a first actuator for loading an external force on the joystick type knob, a second actuator for loading an external force on the rotary knob, a control unit for controlling these first and second actuators, a guide member for defining an operation direction of the joystick type knob, first detection means for detecting an operation state of the joystick type knob, and second detection means for detecting an operation state of the rotary knob. In an onboard instrument control device, the built-in manual input device is contained in a box and the joystick type knob and the rotary knob and push button switches used for instrument selection are disposed on an upper surface of the box.

5 Claims, 9 Drawing Sheets

FORCE FEEDBACK FUNCTIONING MANUAL INPUT DEVICE AND ONBOARD INSTRUMENT CONTROL SYSTEM HAVING IT

BACKGROUND OF THE INVENTION

1. Field of the Invention

This invention relates to a force feedback functioning manual input device and an onboard instrument control system having it, and more particularly relates to an input means that is rendered multifunctional and a technique for integration of the input means.

2. Description of the Related Art

Heretofore, a force feedback functioning manual input device has been known that gives resistant sensation and thrust to a knob corresponding to the operation magnitude and operation direction so that the operation feeling of the knob, which is served as an input means, is rendered realistic for making the knob operation sure.

An example of a manual input device of this type that has been known conventionally is shown in FIG. 10. The manual input device of the present example comprises a rotary knob 101, a detection means 102 for detecting the rotation magnitude and rotation direction of the rotary knob 101, an actuator 103 for loading an external force on the rotary knob 101, a control unit 104 for taking in a detection signal a supplied from the detection means 102 and for generating a control signal c to operate the actuator 103, a D/A converter 105 for D/A converting a control signal c generated from the control unit 104, and a power amplifier 106 for amplifying a control signal c that has been converted to an analog signal by means of the D/A converter 105 to obtain the power for driving the actuator 103. The control unit 104 has a CPU 104*a* and a memory 104*b*, and the memory 104*b* has stored the control signal c corresponding to the detection signal a in the form of a table. The CPU 104*a* takes in a detection signal a from the detection means 102, reads out a control signal c corresponding to the taken-in detection signal a from the memory 104*b*, and supplies it to the D/A converter 105.

Thereby, the actuator 103 is driven, the force feedback corresponding to the operation magnitude and operation direction is transmitted to the rotary knob 101. As the result, the manual input device of this example is excellent in the operation feeling of the rotary knob 101, and the rotary knob 101 can be operated consistently.

A manual input device of this type is applied to a by-wire gear shift unit of an automobile and various onboard electric instrument such as an air conditioner, a radio, a television set, a CD player, and a navigation system as the function control system.

In the case of application as gear shift device, the force feedback function provides a click feeling when a shift lever range is changed, and used as a lock means for inhibiting incorrect operation of a shift lever from a specific range to another specific range such as shift from P (parking) range to R (reverse) range and shift from D (drive) range to 2nd (second) range. Furthermore, in the case of application as a function control system of an onboard electric instrument, the force feedback function of a manual input device provides a suitable resistance feeling to a rotary knob 101 to make the fine adjustment of the function easy, or provides a suitable thrust to a rotary knob 101 to make operation of the rotary knob light.

The manual input device provided with the rotary knob 101 is described as an example in the above, however in addition to the abovementioned rotary knob 101, a manual input device provided with a joystick type knob that is swingable in two-dimensional direction and a manual input device provided with a lever-type knob that is turned in a certain plane have been known conventionally.

However, a manual input device having a plurality of coaxial knobs wherein each of the plurality of coaxial knobs is controlled with force feedback individually has not been proposed, and the conventional manual input device has been insufficient in multifunction performance and integration performance.

For example, in the case where an exemplary manual input device shown in FIG. 9 is applied as a function control system for controlling onboard instruments, so many instruments to be controlled are mounted and so many functions to be controlled should be involved. If a system is designed so that the function of all the onboard instruments is controlled with only one rotation knob 101, the operability of the system is poor and the system leads to wrong operation. On the other hand, if a plurality of manual input devices are deployed on an onboard instrument control system in parallel, the manual input devices need a large space and the onboard instrument system is rendered large-sized, and such an onboard instrument control system will be expensive.

The present invention has been accomplished to solve the abovementioned conventional technique, and it is an object of the present invention to provide a small-sized and low-cost manual input device excellent in operability and multifunctionality, and to provide a small-sized and low cost onboard instrument control system provided with a manual input device of this type that is excellent in operability and multifunctionality.

SUMMARY OF THE INVENTION

The present invention has been accomplished to solve the abovementioned problem, and a manual input device is provided with a joystick type knob and a rotary knob that are disposed coaxially, one first actuator for loading an external force on the joystick type knob, one second actuator for loading an external force on the rotary knob, first detection means for detecting an operation state of the joystick type knob, and second detection means for detecting an operation state of the rotary knob.

Because the manual input device provided with the joystick type knob and the rotary knob allows use of a plurality of knobs properly corresponding to an electric instrument and function that are to be controlled as described hereinabove, the operability of the manual input device is improved and the manual input device is rendered multifunctional. Furthermore, because the coaxial arrangement of the knobs allows the knobs to be disposed intensively on a limited space, the small-sized input device is realized. Furthermore, because the structure that one first actuator loads a force feedback external force on the joystick type knob allows the number of actuators of the manual input device to be minimized, it is possible to configure the manual input device intensively in comparison with the case where two or more actuators load a force feedback external force on the joystick type knob, and a small-sized, low-cost, and power saving manual input device can be realized.

The manual input device of the present invention is provided with a guide member for defining an operation direction of the joystick type knob.

The joystick type knob is operated only in a predetermined direction because of the guide member, and the signal input operation can be operated easily and consistently by use of the joystick type knob.

According to the present invention, a control unit that controls the first actuator based on a signal supplied from the first detection means and controls the second actuator based on a signal supplied from the second detection means is provided combinedly in a box that constitutes the manual input device.

Because the control unit of the first and second actuators is provided combinedly in the box that constitutes the manual input device and it is not necessary to change an external apparatus, the manual input device can be applied easily to an external apparatus.

Furthermore, according to the present invention, a control unit that controls the first actuator based on a signal supplied from the first detection means and that controls the second actuator based on a signal supplied from the second detection means is provided in an external apparatus.

Because the control unit of the first and second actuators is provided in an external apparatus and the control unit can be omitted from the manual input device thereby, a small-sized and low-cost manual input device can be realized.

On the other hand, according to the present invention, an onboard instrument control device has electric instrument selection switches for selecting an electric instrument the function of which is to be controlled and a manual input device for controlling various functions of the electric instrument selected by use of one of the selection switches, wherein the onboard instrument control device is provided with the manual input device having a joystick type knob and a rotary knob that are disposed coaxially, a first actuator for loading an external force on the joystick type knob, a second actuator for loading an external force on the rotary knob, first detection means for detecting an operation state of the joystick type knob, and second detection means for detecting an operation state of the rotary knob.

Because the onboard instrument control device is provided with electric instrument selection switches for selecting an electric instrument the function of which is to be controlled and the manual input device for controlling various functions of the electric instrument selected by use of a selection switch and the function of many electric instruments can be controlled intensively by means of one onboard instrument control device, the function of various onboard electric instruments can be controlled easily and the driving safety performance of an automobile is improved. Furthermore, because a manual input device of an onboard instrument control device provided with a joystick type knob and rotary knob is used and the plurality of knobs can be used properly corresponding to an electric instrument or the function to be controlled, the operability of the onboard instrument control device is improved and the onboard instrument control device is rendered multifunctional. Furthermore, because knobs are disposed coaxially and the space where the knobs are disposed is reduced, a small-sized onboard instrument control device is realized. Furthermore, because one first actuator loads a force feedback external force on the joystick type knob and the number of actuators to be provided in the onboard instrument control device is minimized thereby, the structure of the onboard instrument control device is intensified in comparison with the case where two or more first actuators load a force feedback external force on the joystick type knob and a small-sized, low-cost, and power-saving onboard instrument control device is realized.

DETAILED DESCRIPTION OF THE PREFERRED EMBODIMENTS

Figure 1:
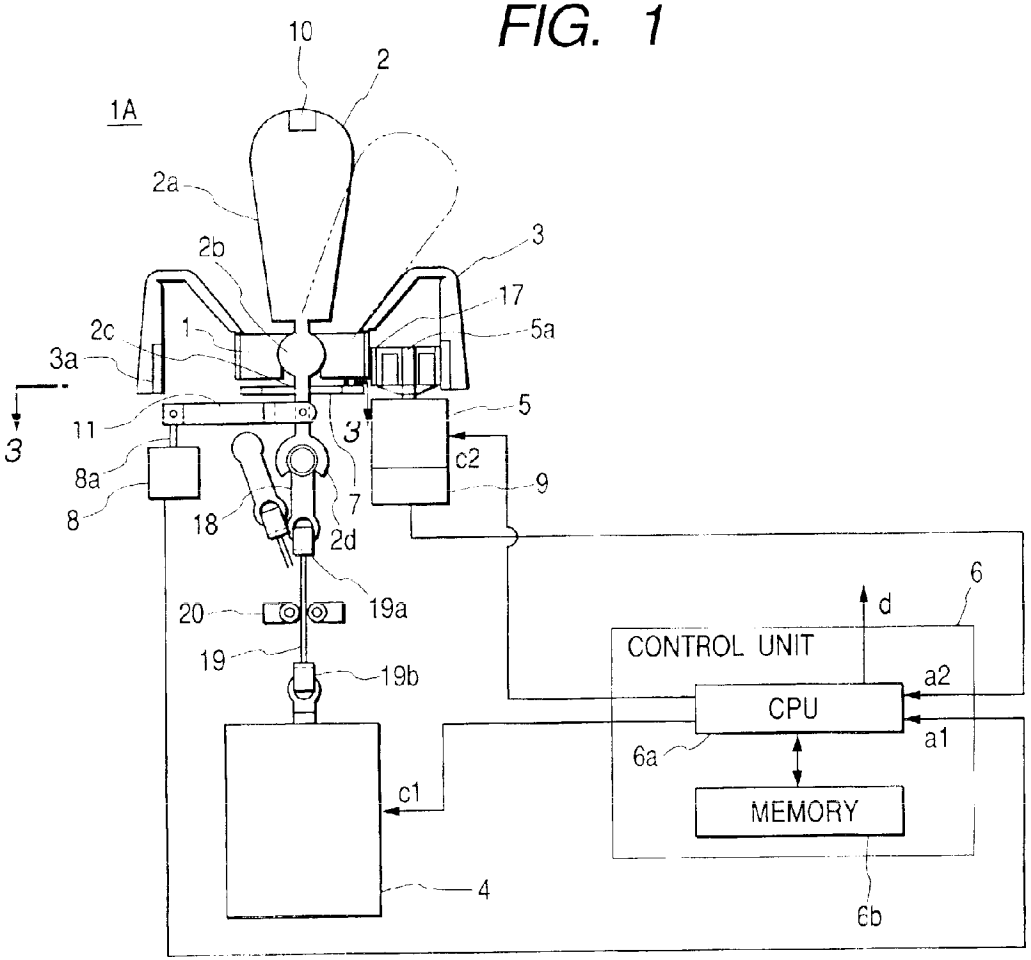
FIG. 1 is a partial cross sectional view of a manual input device in accordance with an embodiment viewed from the front direction.

An example of a manual input device in accordance with the present invention will be described in detail hereinafter with reference to FIG. 1 to FIG. 4. FIG. 1 is a partial cross sectional view viewing from the front direction of the manual input device of the present example, FIG. 2 is a partial cross sectional view viewing from the side direction of the manual input device of the present example, FIG. 3 is a view along the 3—3 line of FIG. 1, and FIG. 4 is a perspective view showing the structure of a stick controller.

Figure 2:
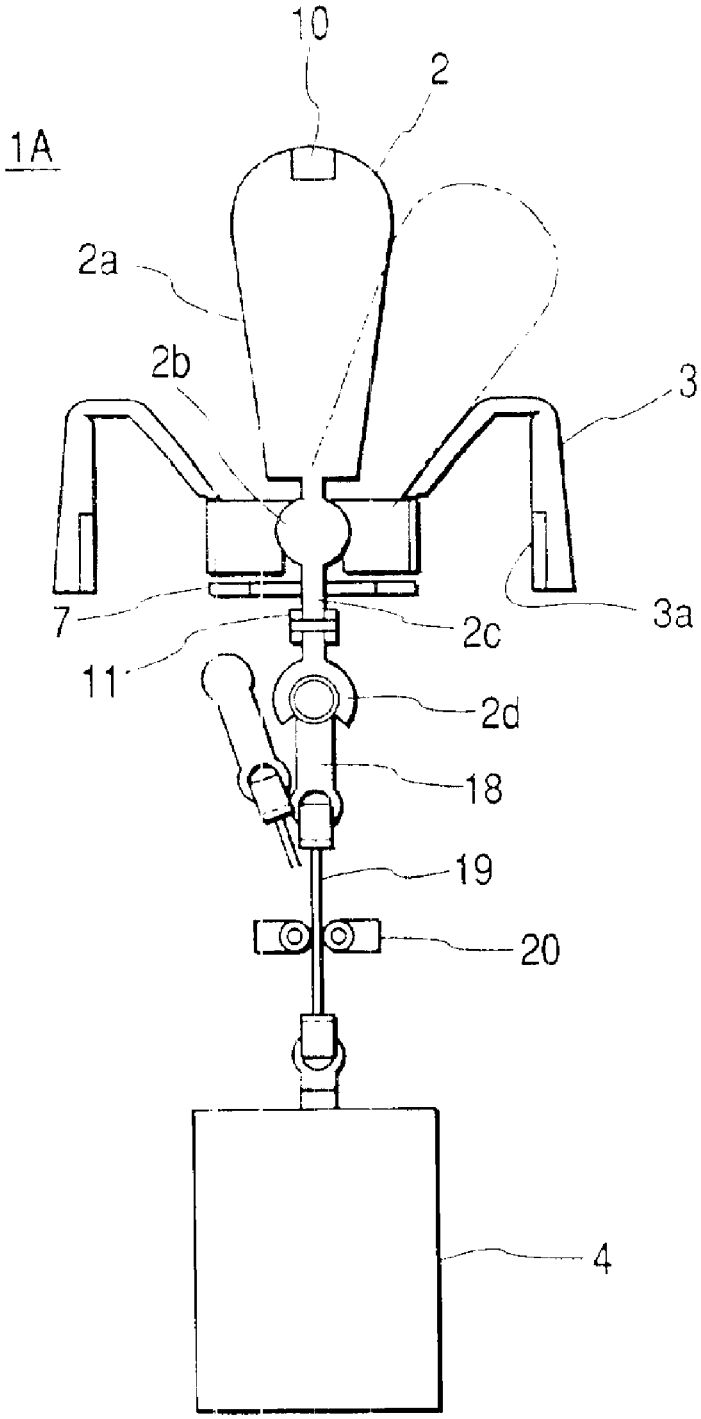
FIG. 2 is a partial cross sectional view of the manual input device in accordance with the embodiment viewed from the side direction.
Figure 3:
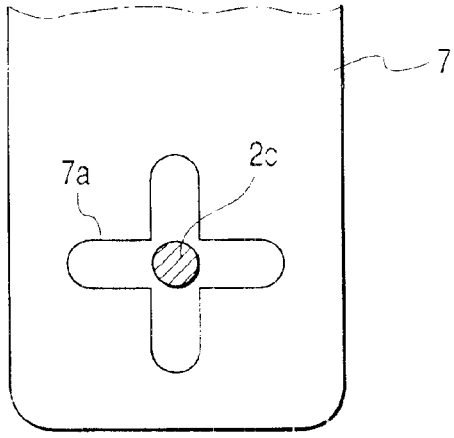
FIG. 3 is an end surface view along the line 3—3 of FIG. 1.

As shown in FIG. 1 and FIG. 2, the manual input device 1A of the present example is provided with a spherical shaft bearing 1, a joystick type knob 2 held swingably on the spherical shaft bearing 1, a rotary knob 3 disposed coaxially with the joystick type knob 2, a first actuator 4 for loading an external force on the joystick type knob 2, a second actuator 5 for loading an external force on the rotary knob 3, a control unit 6 for controlling these first and second actuators 4 and 5, a guide member 7 for defining the operation direction of the joystick type knob 2, a first detection means 8 for detecting the operation state of the joystick type knob 2, and a second detection means 9 for detecting the operation state of the rotary knob 3.

The joystick type knob 2 comprises a holding portion 2*a*, a spherical portion 2*b*, a connection portion 2*c* and a bearing portion 2*d*, and the spherical portion 2*b* is held swingably by the spherical bearing 1. A push button switch 10 is provided on a portion of the holding portion 2*a*. When the push button switch 10 is operated at a desired timing after the holding portion 2*a* is operated, a signal generated from the first detection means 8 is settled. The connection portion 2*c* is inserted through a cross-shaped guide hole 7*a* formed on the guide member 7 as shown in FIG. 3, and the guide member 7 defines the operation direction and the operation range of the joystick type knob 2. Only the guide member 7 on which the cross-shaped guide hole 7*a* is formed is shown exemplarily in FIG. 3, but the configuration of the guide hole 7*a* is by no means limited to the abovementioned cross shape, for example, a guide hole 7*a* of an arbitrary configuration such as a joystick type knob 2 for guiding 6 or 8 directions may be formed. The connection portion 2*c* is connected to an operation lever 8*a* of the first detection means 8 with interposition of a link 11. A stick controller may be used as the first detection means 8.

Figure 4:
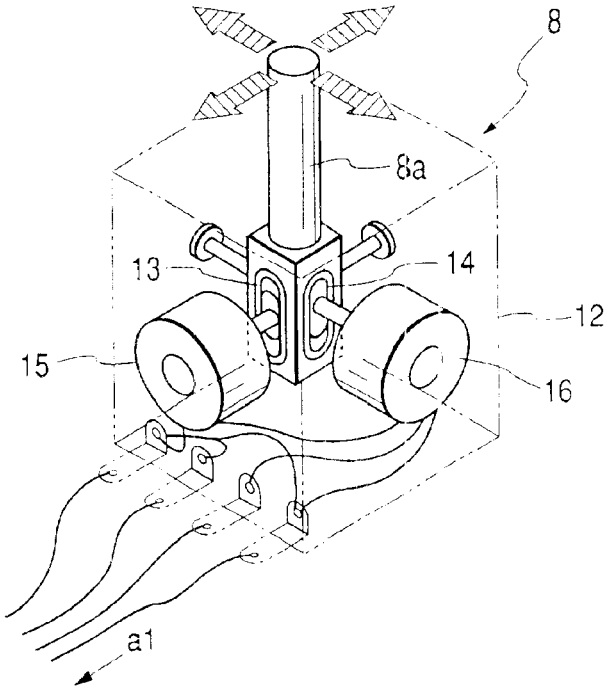
FIG. 4 is a perspective view showing a stick controller of the manual input device in accordance with the embodiment.

As shown in FIG. 4, the stick controller (first detection means 8) comprises an operation lever 8*a* that is held swingably on a box 12, a converter 15 for converting the swing motion of the operation lever 8*a* to the rotation motion of two rotors 13 and 14 disposed orthogonally each other, and two rotary type encoders or variable resistors 15 and 16 for converting the rotation magnitude and rotation direction of the two rotors 13 and 14 to the electric signal, and the encoders or variable resistors 15 and 16 generate the first detection signal a1 corresponding to the swing magnitude and the swing direction of the holding portion 2*a*.

The rotary knob 3 is shaped in the form of circular ball, and an internal tooth gear 3*a* is formed in the circumferential direction on the internal surface. The internal tooth gear 3*a* is engaged with a pinion 17 fixed to a drive shaft 9*a* of the second detection means 9. A rotary type encoder or variable resistor that is capable of converting the rotation magnitude and the rotation direction of the rotary knob 3 to the electric signal may be used as the second detection means 9, and the second detection means 9 generates a second detection signal a2 corresponding to the rotation magnitude and the rotation direction of the rotary knob 3.

For example, a voice coil motor such as a linear motor or solenoid may be used as the first actuator 4. The bearing portion 2*d* of the joystick type knob 2 is connected to the drive shaft 4*a* of the first actuator 4 with interposition of a first connection member 18 and a second connection member 19. In other words, as shown in FIG. 1 and FIG. 2, the bearing portion 2*d* is shaped in the form of ball bearing, the one end of the first connection member 18 connected to the bearing portion 2*d* is shaped spherical, and the first connection member 18 is connected swingably to the joystick type knob 2. Furthermore, the second connection member 19 comprises a wire having pin joints 19*a* and 19*b* at both end portions, and the respective pin joints 19*a* and 19*b* are connected to the bottom portion of the first connection member 18 and the drive shaft 4*a* of the first actuator 4 by means of pin connection. As the result, the joystick type knob 2 is mechanically connected to the first actuator 4 normally regardless of the swinging magnitude and swinging direction of the joystick type knob 2, and the driving force of the first actuator 4 is loaded on the joystick type knob 2. In the drawings, the character 20 indicates a wire guide, a roller 20*a* may be provided on the point end portion of the wire guide 20 for smooth motion of the second connection member 19.

On the other hand, for example, a rotation motor such as a DC motor or a stepping motor may be used as the second actuator 5.

The control portion 6 comprises a CPU 6*a* and a memory 6*b*, and the memory 6*b* stores the data and program for analyzing the detection signals a1 and a2 and the driving data and driving program of the first and second actuators 4 and 5. The CPU 6*a* takes in the detection signals a1 and a2, analyzes the detection signals a1 and a2 based on the data and program stored in the memory 6*b*, decides control signals c1 and c2 corresponding to the detection signals a1 and a2 based on the data and program stored in the memory 6*b*, and supplies the control signals c1 and c2 to the first actuator 4 and second actuator 5. Furthermore, the control portion 6 is connected to electric instruments (not shown in the drawings) to be subjected to function control by means of the manual input device 1A, generates a control signal d for an electric instrument corresponding to the detection signals a1 and a2, and thereby control the function of a desired electric instrument. The control portion 6 may be disposed in the manual input device 1A or may be provided in an external device.

Control signals c1 and c2 are signals corresponding to the operation feeling provided to the knobs 2 and 3. Examples of signal types include "generation of vibration, "generation of shock force", and "change of action force". In the case where the signal type is "generation of vibration", control signals c1 and c2 that express the vibration intensity, vibration form, load time, and frequency are generated. Furthermore, in the case where the signal type is "generation of shock force", control signals c1 and c2 that express the shock intensity, shock form, and load frequency are generated. Furthermore, in the case where the signal type is "action force change", control signals c1 and c2 that express the action force intensity, generation direction of an action force, and loading time are generated.

The operation of the manual input device 1A having the abovementioned structure will be described hereunder.

When the joystick type knob 2 is swung, the motion is transmitted to the operation lever 8*a* of the stick controller (first detection means 8) with interposition of the link 11, and a first detection signal a1 corresponding to the swing magnitude and swing direction of the joystick type knob 2 is generated from the encoders or variable resistors 15 and 16 of the stick controller (first detection means 8). The first detection signal a1 is taken in the CPU 6*a*, and converted to a control signal c1 of the first actuator 4 according to the data and program stored in the memory 6*b*. The first actuator 4 is driven by the control signal c1, and loads a particular external force on the joystick type knob 2 corresponding to the swing magnitude and swing direction of the joystick type knob 2. Furthermore, the CPU 6*a* generates a control signal d to select an electric instrument the function of which is to be controlled and to control the function of the selected electric instrument correspondingly to the first detection signal a1.

Figure 5:
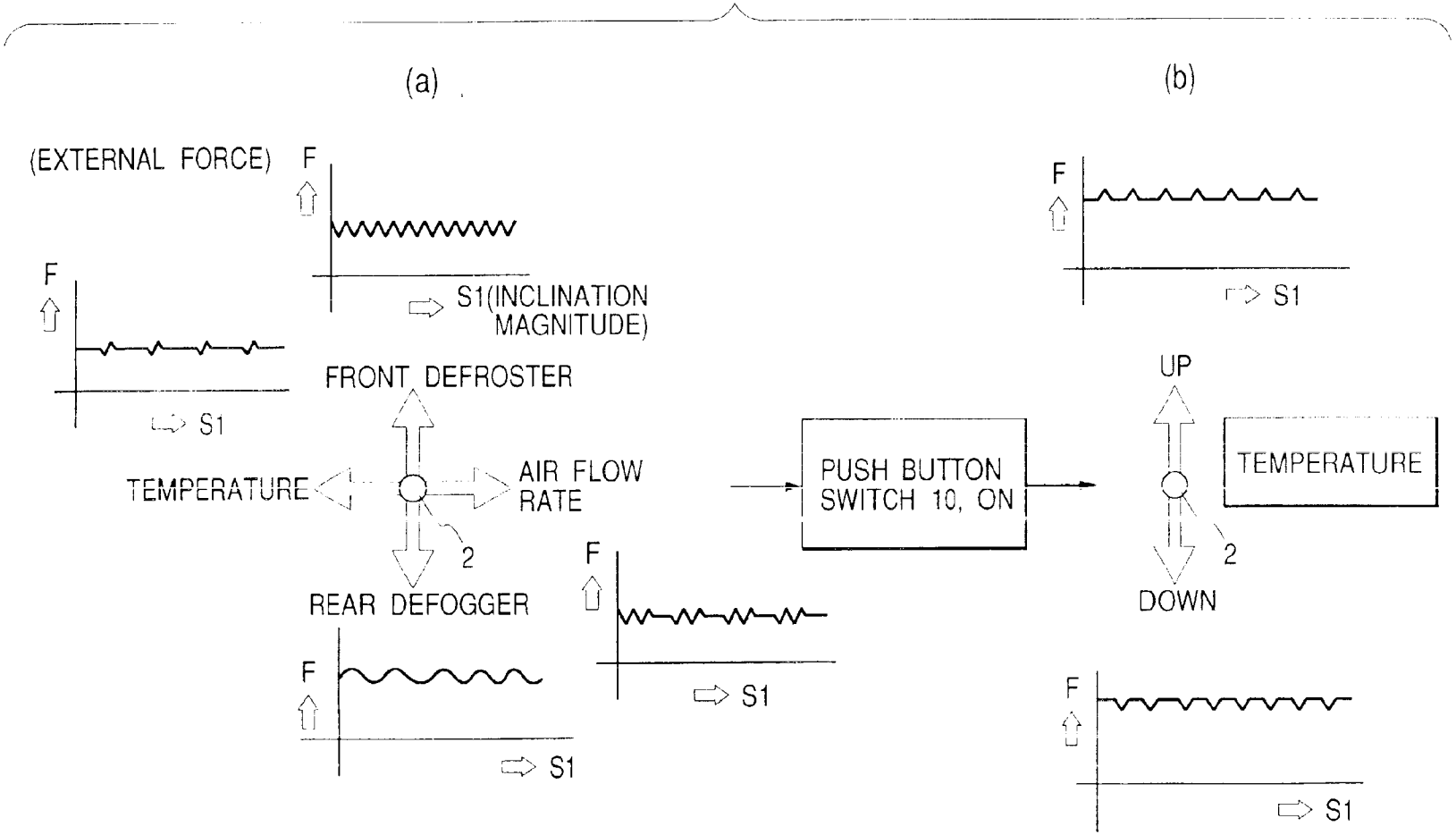
FIG. 5 is an explanatory diagram for describing the operation of a joystick type knob that is applied to function selection and function control of an onboard air-conditioner.

FIG. 5 is a diagram for describing the action in the case where a joystick type knob 2 is applied for function selection and function control of an onboard air-conditioner. As shown in FIG. 5(*a*), the joystick type knob 2 is inclined in a forward direction, a backward direction, a left direction, or a right direction from the center position to select the front defroster, rear defogger, temperature control, or air flow rate control respectively. The first detection signal a1 generated from the stick controller 8 is changed corresponding to the inclined magnitude and inclined direction of the joystick type knob 2. The CPU 6*a* takes in the first detection signal a1 and generates a control signal c1 corresponding to the first detection signal a1 to drive the first actuator, and then loads an external force of the desired mode on the joystick type knob 2. Four graphs shown in FIG. 5(*a*) are graphs for exemplarily showing the relation between the inclination magnitude S1 of the joystick type knob 2 and the external force F exerted on the joystick type knob 2. As shown in these graphs, the external force F having different forms corresponding to the inclination direction of the joystick type knob 2 are loaded respectively on the joystick type knob 2. Thereby, an operator can recognize that the joystick type knob 2 is operated in the intended direction without viewing the joystick type knob 2. Furthermore, in addition to the above, to prevent the joystick type knob 2 from being operated in the wrong direction, it is possible that an external force for guiding the joystick type knob 2 only in the correct direction, namely the forward inclination, backward inclination, left inclination, or right inclination from the center position in the example shown in FIG. 5, is loaded on the joystick type knob 2 from the force feedback actuator 4.

The selection of the front defroster, rear defogger, temperature control, or air flow rate control is settled finally by the push button switch 10, and the CPU 6*a* is connected to a selected electric instrument. For example, in the case where the joystick type knob 2 is inclined in the left direction to select the temperature control of an air-conditioner, the joystick type knob 2 is switched to the temperature control means of the air-conditioner. As shown in FIG. 5(*b*), the joystick type knob 2 is inclined forward from the center position to increase the temperature or inclined backward from the center position to decrease the temperature. Also in this case, the CPU 6*a* takes in the first detection signal a1 generated from the stick controller 8, and generates a control signal c1 corresponding to the first detection signal a1. Then, the control signal c1 drives the first actuator 4, and desired external forces exemplarily shown in the respective graphs shown in FIG. 5(*b*) are loaded on the joystick type knob 2. The mode of the external force used when the function of the air-conditioner is selected may be the same as or different from the mode of the external force used when the function of the air-conditioner is controlled with respect to the operation of the joystick type knob 2 in the same direction. FIG. 4 shows a different case. A method in which the function of an air-conditioner is selected by means of a joystick type knob 2 and the function of the air-conditioner is controlled by means of a rotary knob 3 may be employed. The operation of a rotary knob 3 will be described hereunder.

On the other hand, when the rotary knob 3 is turned, the motion is transmitted to a drive shaft of the second detection means 9 with interposition of the internal tooth gear 3*a* and the pinion 17, and the second detection means 9 generates a second detection signal a2 corresponding to the rotation magnitude and the rotation direction of the rotary knob 3. The CPU 6*a* takes in the second detection signal a2, and converts it to a control signal c2 of the second actuator 5 according to the data and program stored in the memory 6*b*. The second actuator 5 is driven by the control signal c2, and loads a particular external force on the rotary knob 3 corresponding to the rotation magnitude and/or rotation direction of the rotary knob 3. The CPU 6*a*, according to the second detection signal a2, selects an electric instrument the function of which is to be controlled and controls the function of the selected electric instrument.

Figure 6:
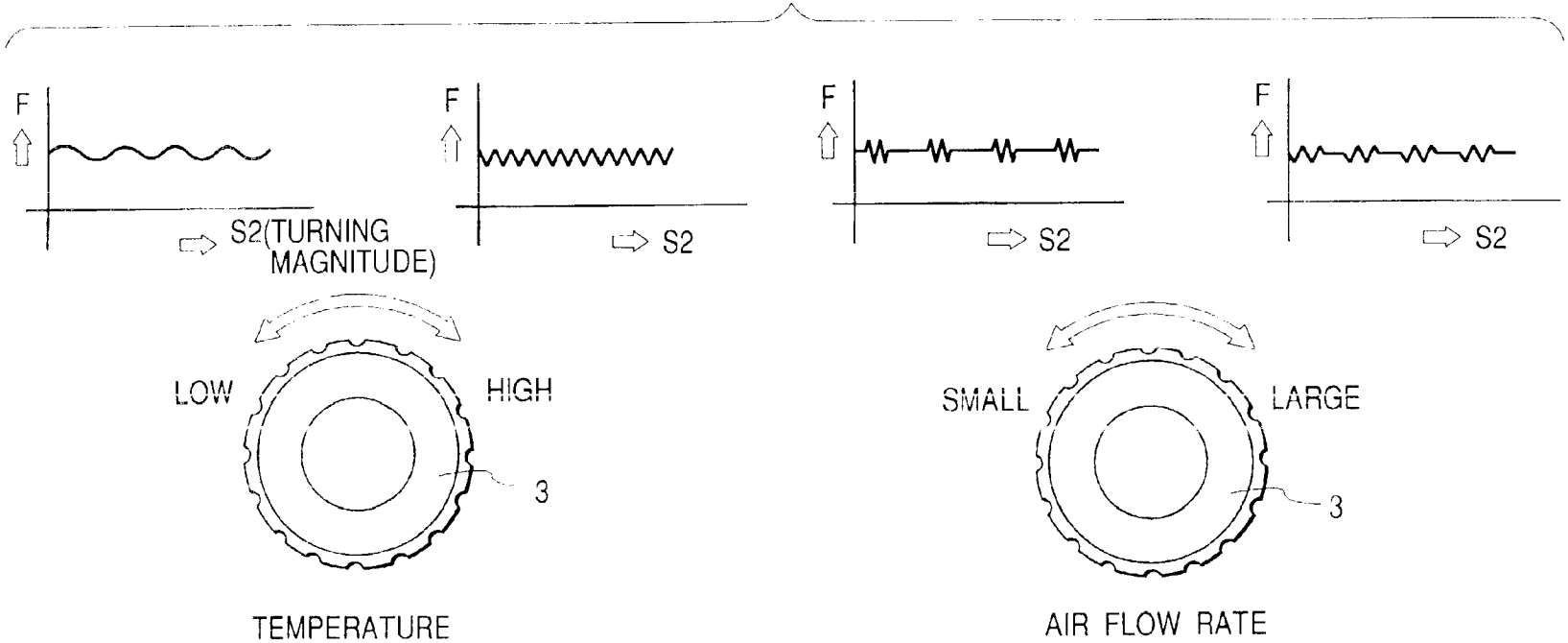
FIG. 6 is an explanatory diagram of a rotary knob that is applied to function control of an onboard air-conditioner.

FIG. 6 is a diagram for describing the case where a rotary knob 3 is applied to control the function of an onboard air-conditioner. The rotary knob 3 is turned left or right from the center position to increase the temperature of the air-conditioner or decrease the temperature of the air-conditioner, or to increase the air flow rate of the air-conditioner or decrease the air flow rate of the air-conditioner. In this case, the CPU 6*a* generates a control signal c2 corresponding to a second detection signal a2 that is different depending on the turning magnitude and turning direction of the rotary knob 3 to drive the second actuator 5, and loads an external force of a desired mode on the rotary knob 3 as shown in FIG. 6. Graphs shown in FIG. 6 are graphs for exemplarily showing the relation between the turning magnitude S2 of the rotary knob 3 and the external force F that is exerted on the rotary knob 3. As shown in these graphs, the external force that is different depending on the turning direction of the rotary knob 3 is loaded on the rotary knob 3. Thereby, an operator can recognize that an electric instrument to be operated is operated by means of the rotary knob 3 without viewing the rotary knob 3. The mode of the external force used when the temperature of the air-conditioner is controlled may be the same as or different from the mode of the external force used when the air flow rate of the air-conditioner is controlled with respect to the operation of the rotary knob 3 in the same direction. FIG. 6 shows a different case.

A case where the function of an air-conditioner is described exemplarily in the abovementioned embodiment, however, the application of the manual input device in accordance with the present invention is by no means limited to the above, for example, the present invention is applicable to various onboard electric instruments such as a radio, a television set, a CD player, a car navigation system, a handle tilting device, a seat attitude control unit, a telephone, a voice recognition device, and a gear shift device.

Figure 7:
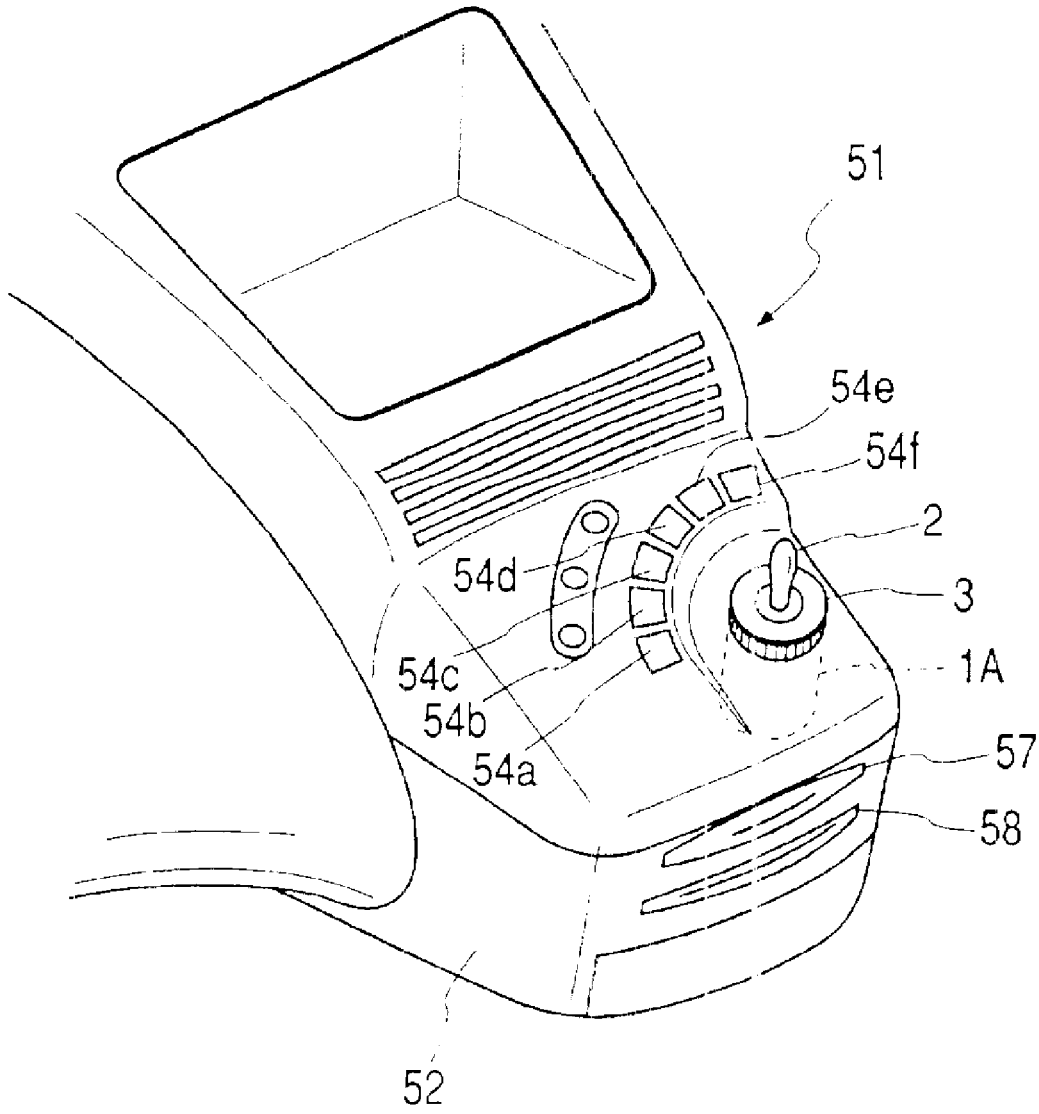
FIG. 7 is a partial perspective view of an onboard instrument control device in accordance with the embodiment that is fixed on a dashboard.

Next, one example of an onboard instrument control device in accordance with the present invention will be described with reference to FIG. 7 to FIG. 9. FIG. 7 is a partial perspective view showing an onboard instrument control device in accordance with the present embodiment that is fixed on a dashboard, FIG. 8 is a partial plan view showing the onboard instrument control device in accordance with the present embodiment including the state of the cabin of an automobile, and FIG. 9 is a functional block diagram of the onboard instrument control device in accordance with the present embodiment.

As shown in FIG. 7, the onboard instrument control device 51 in accordance with the present embodiment is contained in a box 52 having a desired size that is formed in the shape of box, and a built-in manual input device 1A in accordance with the abovementioned embodiment is contained in the box 52, a joystick type knob 2 and a rotary knob 3 of the manual input device 1A are disposed above the box 52. Six push button switches 54*a*, 54*b*, 54*c*, 54*d*, 54*e*, and 54*f* disposed in the form of circular arc having the center at the setting portion of the knob 3 are disposed on the upper surface of the box 52, and a card slot 57 and a disc slot 58 are formed on the front surface of the box 52. The character D in the drawing shows a display device.

Figure 8:
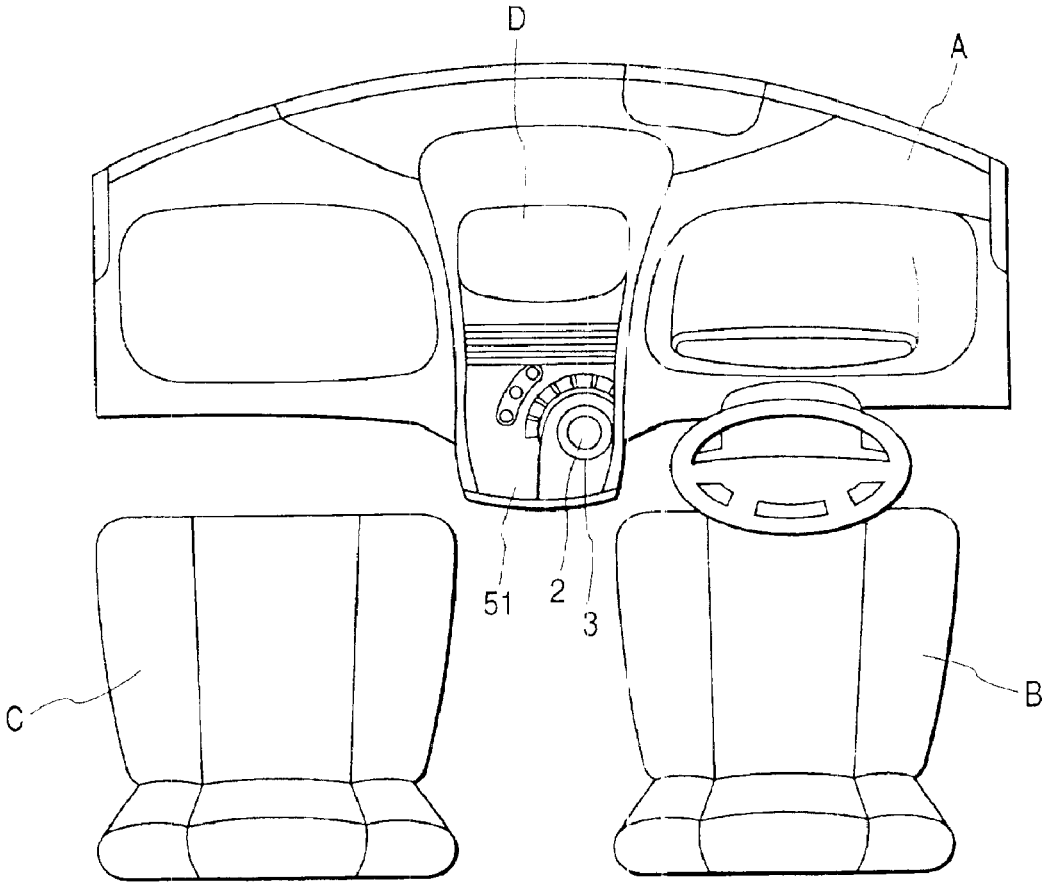
FIG. 8 is a partial plan view showing the onboard instrument control device in accordance with the embodiment that is fixed in the cabin of an automobile.
Figure 9:
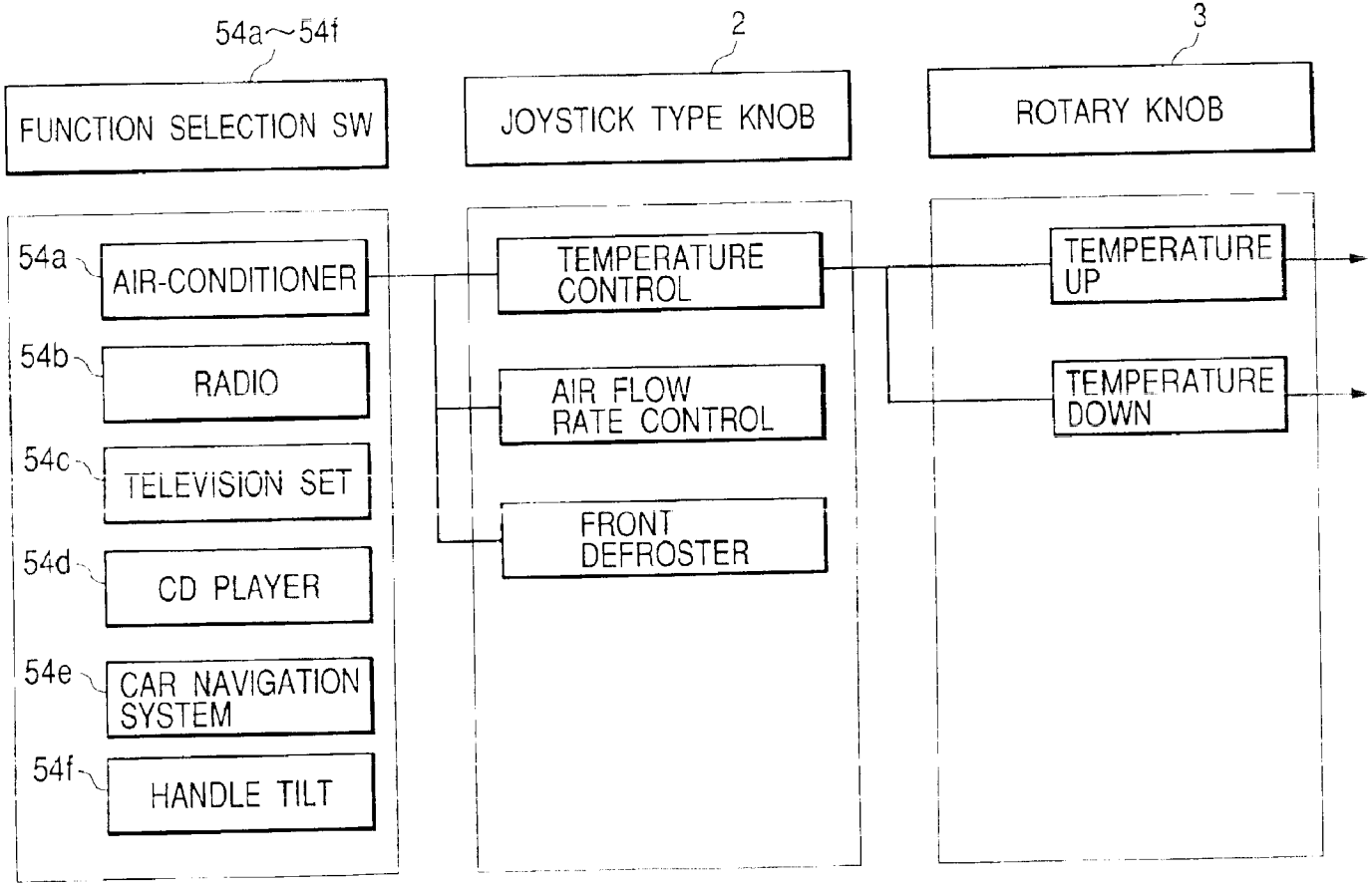
FIG. 9 is a function block diagram of the onboard instrument control device in accordance with the embodiment.
Figure 10:
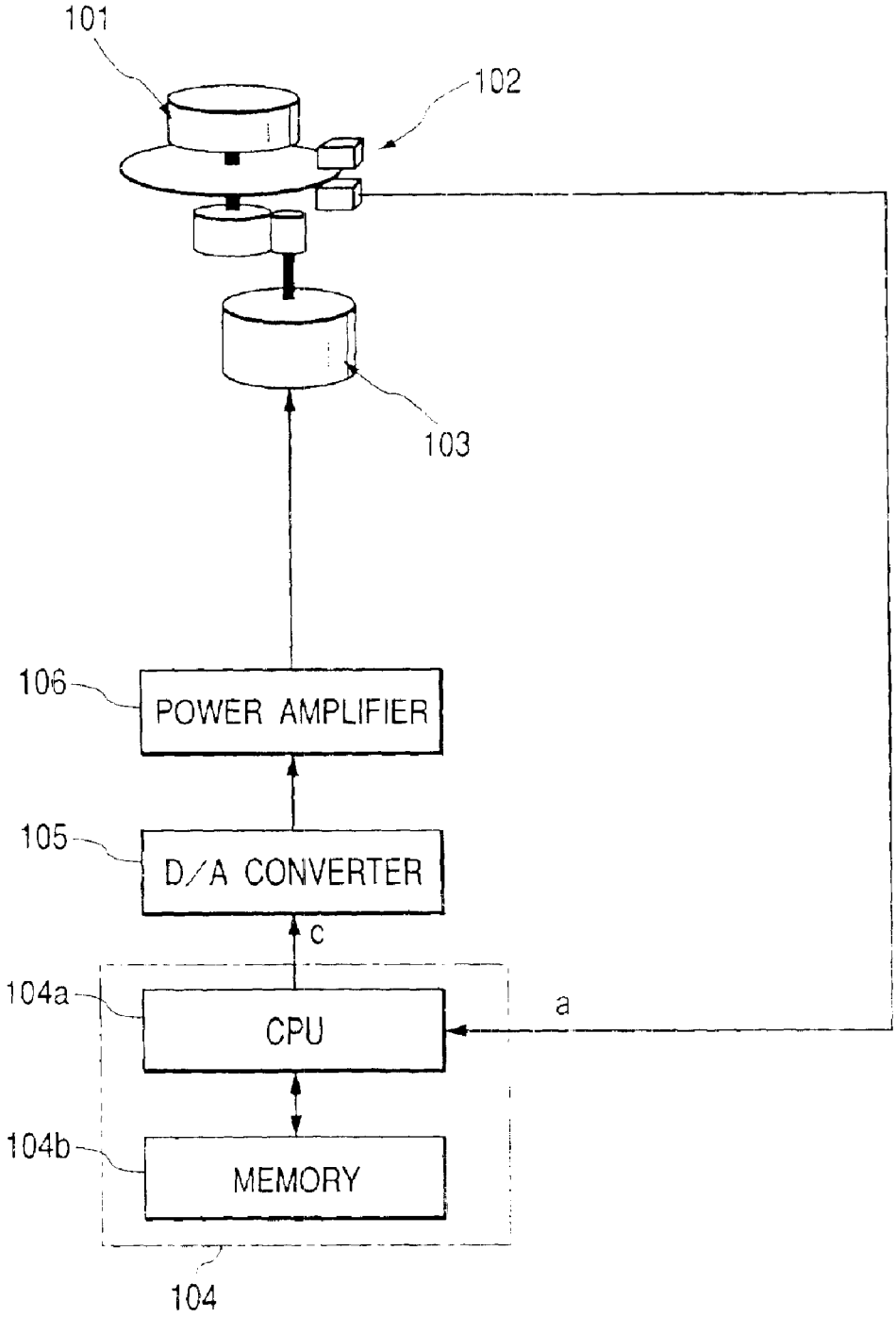
FIG. 10 PRIOR ART
FIG. 10 is a structure diagram of a manual input device in accordance with a conventional example.

As shown in FIG. 8, the onboard instrument control device is fixed on the dashboard A of an automobile between the driver seat B and a front passenger seat C.

The six push button switches 54*a* to 54*f* arranged in the form of circular arc are served as the electric instrument selection switch used for selecting an onboard electric instrument to be operated by use of the onboard instrument control device 51 of the present example such as an air-conditioner, a radio, a television set, a CD player, a car navigation system, a handle tilting device, a seat attitude control unit, a telephone, and a gear shift device, and connected to each onboard electric instrument separately. A push button switch may be connected arbitrarily to any one of the onboard electric instruments. In the case of the onboard instrument control device 51 of the present example, as shown in FIG. 9, the push button switch 54*a* is connected to the air-conditioner, the push button switch 54*b* is connected to the radio, the push button switch 54*c* is connected to the television set, the push button switch 54*d* is connected to the CD player, the push button switch 54*e* is connected to the car navigation system, and the push button switch 54*f* is connected to the handle tilting device. An operator pushes and operates the knob of a desired push button switch to select a corresponding onboard electric instrument connected to the pushed push button switch.

The built-in manual input device 1A contained in the box 52 is used as the function control means of the onboard electric instrument selected correspondingly to the push button switches 54*a* to 54*f*, for example, in the case where the air-conditioner is selected correspondingly to the push button switch 55*a*, the joystick type knob 2 is operated to select the function such as front defroster, rear defogger, temperature control, or air flow rate, and the joystick type knob 2 or rotary knob 3 is operated to select the function such as temperature control or air flow rate control of the air-conditioner. The method for selecting the function of the air-conditioner and the method for controlling the temperature by use of the joystick type knob 2 and rotary knob 3 are described already and the force feedback control of the joystick type knob 2 and the rotary knob 3 that are performed at that time are described in the description of the embodiment of the manual input device already. Therefore, the detailed description is omitted.

Though the case where the onboard electric instrument is selected by use of the push button switches 54*a* to 54*f*, the function of the onboard electric instrument is selected by use of the joystick type knob 2, and the function of the onboard electric instrument is controlled by use of the joystick type knob 2 or the rotary knob 3 is described in the present example, however, another different case where a function selection switch of an onboard electric instrument is provided on a portion of the box 52 that constitutes the onboard instrument control device 51 and the joystick type knob 2 and the rotary knob 3 are used only for controlling the function of the instrument may be employed.

As described hereinabove, because the onboard instrument control device of the present example realizes the centralized control of a plurality of onboard electric instruments, the function of onboard electric instruments can be controlled easily, and the driving safety of the automobile is improved. Furthermore, because a manual input device having a plurality of knobs is used, these knobs can be used properly and correspondingly to the electric instrument to be controlled and the function, and the operability of the onboard instrument control device is improved and the onboard instrument control device is rendered multifunctional.

Because the manual input device of the present invention is provided with a joystick type knob and a rotary knob both, knobs can be used properly and correspondingly to the instrument to be controlled and the function. As the result, the operability of the manual input device is improved and the manual input device is rendered multifunctional. Furthermore, because the manual input device of the present invention is provided with a plurality of knobs that are arranged coaxially, the space for the knobs can be centralized intensively and the small-sized manual input device is realized. Furthermore, because the manual input device of the present invention has the structure that one first actuator loads the force feedback external force on the joystick type knob, the number of actuators to be provided on the manual input device is minimized and the structure of the manual input device is centralized intensively, and the small-sized, low-cost and power-saving manual input device is realized. In addition to the above, because the manual input device of the present invention is provided with a guide member, the joystick type knob is operated only in the predetermined particular direction, and the signal input operation by use of the joystick type knob is performed easily and consistently.

Furthermore, because the onboard instrument control device of the present invention is provided with the electric instrument selection switch for selecting an electric instrument the function of which is to be controlled and provided with the manual input device for controlling various functions of the selected electric instrument selected by use of the selection switch, the function of many electric instruments can be controlled intensively by use of one onboard instrument control device, the function of various electric instruments is controlled easily, and the driving safety of an automobile is improved. Furthermore, because the onboard instrument control device of the present invention is provided with the manual input device comprising the joystick type knob and rotary knob arranged coaxially, the one first actuator for loading an external force on the joystick type knob, the one second actuator for loading an external force on the rotary knob, the guide member for defining the operation direction of the joystick type knob, the first detection means for detecting the operation state of the joystick type knob, and the second detection means for detecting the operation state of the rotary knob, the effect that is particular for the manual input device is achieved.

What is claimed is:

1. A manual input device comprising:

a joystick type knob;

a rotary knob that is disposed coaxially with the joystick type knob;

a first actuator to load an external force on the joystick type knob;

a second actuator to load an external force on the rotary knob;

a first detector to detect an operation state of the joystick type knob; and a second detector to detect an operation state of the rotary knob.

2. The manual input device according to claim 1, further comprising a guide member to define an operation direction of the joystick type knob.

3. The manual input device according to claim 1, further comprising a control unit that controls the first actuator based on a signal supplied from the first detector and controls the second actuator based on a signal supplied from the second detector, the control unit provided in a box that houses the manual input device.

4. The manual input device according to claim 1, further comprising a control unit that controls the first actuator based on a signal supplied from the first detector and controls the second actuator based on a signal supplied from the second detector, the control unit provided in an external apparatus.

5. An onboard instrument control device comprising:

electric instrument selection switches to select an electric instrument having a function to be controlled; and a manual input device to control various functions of the electric instrument selected by use of one of the selection switches, the manual input device comprising a joystick type knob, a rotary knob that is disposed coaxially with the rotary knob, a first actuator to load an external force on the joystick type knob, a second actuator to load an external force on the rotary knob, a first detector to detect an operation state of the joystick type knob, and second detector to detect an operation state of the rotary knob.

* * * * *